US010127789B2

(12) United States Patent
Abe et al.

(10) Patent No.: US 10,127,789 B2
(45) Date of Patent: Nov. 13, 2018

(54) DISASTER DETERMINATION SYSTEM AND DISASTER DETERMINATION METHOD

(71) Applicant: SMK Corporation, Tokyo (JP)

(72) Inventors: Rie Abe, Kanagawa (JP); Haruhiko Kondo, Kanagawa (JP); Junsoo Kim, Kanagawa (JP); Natsumi Ito, Tokyo (JP); Tsubasa Tanaka, Tokyo (JP)

(73) Assignee: SMK Corporation, Tokyo (JP)

( * ) Notice: Subject to any disclaimer, the term of this patent is extended or adjusted under 35 U.S.C. 154(b) by 0 days.

(21) Appl. No.: 15/618,159

(22) Filed: Jun. 9, 2017

(65) Prior Publication Data

US 2017/0278371 A1 Sep. 28, 2017

Related U.S. Application Data

(63) Continuation of application No. PCT/JP2015/055729, filed on Feb. 20, 2015.

(30) Foreign Application Priority Data

Dec. 11, 2014 (JP) ..... 2014-250695

(51) Int. Cl.

| | |
|---|---|
| ***G08B 23/00*** | (2006.01) |
| ***G08B 21/10*** | (2006.01) |
| ***G08B 31/00*** | (2006.01) |

(52) U.S. Cl.

CPC ..... *G08B 21/10* (2013.01); *G08B 31/00* (2013.01)

(58) Field of Classification Search

CPC ..... G08B 21/10; G08B 31/00; G08B 25/009; G08B 25/10; G08B 17/00; G08B 17/005;

(Continued)

(56) References Cited

U.S. PATENT DOCUMENTS 4,581,605 A 4/1986 Vogt
2003/0234725 A1* 12/2003 Lemelson ..... G08B 7/066 340/521

(Continued)

FOREIGN PATENT DOCUMENTS

JP S63-136193 A 6/1988
JP H06-111172 A 4/1994

(Continued)

OTHER PUBLICATIONS

Innternational Search Report for International Patent Application No. PCT/JP2015/055729, issued by the Japan Patent Office dated May 26, 2015.

*Primary Examiner* — Brian Zimmerman
*Assistant Examiner* — Kevin Lau

(57) ABSTRACT

A plurality of sensing terminal devices and a disaster determination processing device are dispersedly placed at different positions. Each sensing terminal device is configured to send, when occurrence of disaster has been sensed, disaster sensing information to which terminal identification information for specifying the sensing terminal device itself is added, and the disaster determination processing device is configured to determine a disaster status based on the received disaster sensing information. The sensing terminal devices and the disaster determination processing device are connected together via a mesh network. A disaster determination section of the disaster determination processing device is configured to determine a disaster occurrence position and a disaster expansion direction from a placement position and a disaster sensing time for at least two or more of the sensing terminal devices having sent the disaster sensing information.

9 Claims, 5 Drawing Sheets

(58) Field of Classification Search
CPC ..... G08B 17/10; G08B 21/12; G08B 15/02; G08B 17/125; G08B 19/00; G08B 21/182; G08B 23/00; G08B 25/006; G08B 27/003; H04W 4/90
See application file for complete search history.

(56) References Cited

U.S. PATENT DOCUMENTS

| | | | | |
|---|---|---|---|---|
| 2010/0238018 | A1* | 9/2010 | Kelly | G08B 17/10 340/517 |
| 2011/0047230 | A1* | 2/2011 | McGee | H04L 41/0609 709/206 |
| 2012/0025979 | A1* | 2/2012 | Monnerie | G08B 25/006 340/539.22 |

FOREIGN PATENT DOCUMENTS

| | | | |
|---|---|---|---|
| JP | 2006-201961 | A | 8/2006 |
| JP | 2011-107964 | A | 6/2011 |
| JP | 2012-126560 | A | 7/2012 |
| JP | 2013-235554 | A | 11/2013 |

* cited by examiner

DISASTER DETERMINATION SYSTEM AND DISASTER DETERMINATION METHOD

CROSS REFERENCE TO RELATED APPLICATION

The contents of the following Japanese patent application and international application are incorporated herein by reference, Japanese Patent Application No. 2014-250695 filed on Dec. 11, 2014, and International Application No. PCT/JP2015/55729 filed on Feb. 20, 2015.

FIELD

The present invention relates to a disaster determination system and a disaster determination method in which many sensing terminal devices configured to sense occurrence of disaster from a physical change amount and a disaster determination section configured to determine a disaster status are connected to a mesh network and the disaster determination section determines the disaster status based on disaster sensing information sent from any of the sensing terminal devices having sensed occurrence of disaster.

BACKGROUND

The following disaster determination system as in Patent Literature 1 and Patent Literature 2 has been known: many sensing terminal devices each including a sensor configured to detect an abnormality in a physical change amount such as occurrence of smoke or harmful gas or thermal elevation and configured to send disaster sensing information when occurrence of disaster has been sensed from the abnormality in the physical change amount are connected together via a network; and when any of the sensing terminal devices dispersedly arranged at different positions sends the disaster sensing information to the network, a disaster occurrence position is determined from the placement position of the sensing terminal device having sent the disaster sensing information, and this prompts the periphery of the disaster occurrence position to evacuate.

In the disaster determination system of Patent Literature 1, many sensing terminal devices each including the sensor configured to sense occurrence of disaster from the abnormality in the physical change amount are connected together via the mesh network, and any of the sensing terminal devices having sensed occurrence of disaster by the sensor sends, by multi-hop communication via the mesh network, the disaster sensing information indicating sensing of occurrence of disaster to the peripheral sensing terminal devices.

The disaster sensing information is transmitted to the peripheral sensing terminal devices based on a routing table formed at each sensing terminal device forming a mesh topology by transmission of a flooding message. Each sensing terminal device having received the disaster sensing information increments the number of hops contained in the disaster sensing information, and then, transfers such disaster sensing information to other peripheral sensing terminal devices. Thus, it can be estimated that a lower number of hops, which is contained in the received disaster sensing information, of any of the relay sensing terminal devices having received the disaster sensing information results in a closer placement position of such a relay sensing terminal device to the placement position of the sensing terminal device having sent the disaster sensing information, i.e., the disaster occurrence position.

Thus, all of the sensing terminal devices having received the disaster sensing information estimate a distance from the disaster occurrence position based on the number of hops contained in the disaster sensing information, and makes a report according to a reporting level corresponding to the distance. This prompts evacuation from the disaster occurrence position as necessary.

In the disaster determination system of Patent Literature 2, many sensing terminal devices each including the sensor configured to detect, e.g., abnormal thermal elevation are dispersedly arranged at the different positions in a building, and each sensing terminal device is connected to a server functioning as a disaster determination processing device configured to determine a disaster status. In the server, an association with the placement position of the sensing terminal device in the building is stored for each sensing terminal device. The server is configured to periodically monitor the detection state of the sensor of each sensing terminal device. When the sensor of any one of the sensing terminal devices or the sensors of any two or more of the sensing terminal devices detect abnormal thermal elevation, the disaster occurrence position is detected from the placement position(s) of the sensing terminal device(s) including the above-described sensor(s).

Thereafter, the server also periodically monitors the detection state of the sensor of each sensing terminal device at a constant interval, thereby repeating similar processing. A disaster expansion direction and a disaster expansion speed are determined from transition of the setting position of the sensing terminal device having sensed occurrence of disaster by the sensor, and an evacuation path and an evacuation direction in the building are notified to each position in the building based on the determination result.

CITATION LIST

Patent Literature

Patent Literature 1: JP-A-2011-107964
Patent Literature 2: JP-A-2006-201961

SUMMARY

Technical Problems

According to the disaster determination system of Patent Literature 1, many sensing terminal devices are connected together via the mesh network, and therefore, all of the sensing terminal devices can estimate a distance to the disaster occurrence position even when a communication path between any ones of the sensing terminal devices is lost due to fire etc. However, each sensing terminal device can only provide the rough distance to the disaster occurrence position, but cannot provide a disaster occurrence direction and a disaster expansion direction. For this reason, a proper evacuation direction cannot be guided.

In the disaster determination system of Patent Literature 2, each sensing terminal device is connected to the server in the form of a star topology. Thus, when the path for communication with any of the sensing terminal devices is blocked due to disaster such as fire or the sensor of such a sensing terminal device is damaged due to disaster, a proper disaster occurrence position and a proper disaster expansion direction cannot be provided.

Moreover, the detection state of the sensor of each sensing terminal device is monitored at the constant interval, and the placement position of the sensing terminal device having sensed occurrence of disaster is, every monitoring, compared to determine the disaster expansion direction. Thus, even when the sensor senses occurrence of disaster during the monitoring interval, such a state is not promptly transmitted to the disaster determination processing device. For this reason, the disaster occurrence position and the disaster expansion direction cannot be determined in real time in the disaster determination processing device. This leads to a critical defect in this type of disaster determination system under a situation where evacuation guidance needs to be promptly provided. This problem can be mended to some extent if the monitoring interval is shortened. However, when the entire system is, for occurrence of extremely-rare disaster, operated with a shorter monitoring interval than that in long-term normal monitoring, power consumption increases, and malfunction is caused.

The present invention has been made in view of the above-described typical problems, and is intended to provide a disaster determination system and a disaster determination method for reliably detecting a disaster occurrence position even when a communication path between sensing terminal devices is blocked due to occurrence of disaster.

Moreover, it is also intended to provide a disaster determination system and a disaster determination method for promptly detecting a disaster occurrence position and a disaster expansion direction.

Solution to Problem

For accomplishing the above-described goal, a disaster determination system according to a first aspect is a disaster determination system configured such that a plurality of sensing terminal devices and a disaster determination processing device dispersedly placed at different positions are connected together via a mesh network and that the disaster determination processing device determines a disaster status based on disaster sensing information sent via the mesh network from at least one of the sensing terminal devices having sensed a physical change at a placement position due to occurrence of disaster. Each sensing terminal device includes a disaster sensing section configured to monitor a physical change amount at the placement position and sense occurrence of disaster when the physical change amount exceeds a predetermined set value, and a transmission unit configured to send the disaster sensing information to the disaster determination processing device via the mesh network when the disaster sensing section has sensed occurrence of disaster, terminal identification information for specifying each sensing terminal device itself being added to the disaster sensing information. The disaster determination processing device includes a disaster determination section configured to determine the disaster status based on the disaster sensing information received from at least one of the sensing terminal devices via the mesh network. The disaster determination section obtains, for at least one of the sensing terminal devices having sent the disaster sensing information, the sensing terminal device placement position specified from the terminal identification information and a disaster sensing time at which at least one of the sensing terminal devices has sensed occurrence of disaster every reception of the disaster sensing information, and determines a disaster occurrence position and a disaster expansion direction from the placement position and the disaster sensing time for at least two or more of the sensing terminal devices having sent the disaster sensing information.

From the placement position and the disaster sensing time for at least two or more of the sensing terminal devices having sent the disaster sensing information, the disaster determination section obtains the disaster sensing times at multiple different placement positions. Thus, the disaster determination section determines, as the disaster occurrence position, an area surrounded by the multiple different placement positions at which occurrence of disaster has been sensed, and determines the disaster expansion direction from the disaster sensing times at the different placement positions.

After determining the disaster occurrence position and the disaster expansion direction based on the disaster sensing information sent from at least two or more of the sensing terminal devices, the disaster determination section performs similar processing every time the disaster sensing information is newly received from the sensing terminal device having sensed occurrence of disaster, and therefore, can more accurately determine the disaster occurrence position and the disaster expansion direction.

In the disaster determination system according to a second aspect, the transmission unit sends, as the disaster sensing time, the time at which the disaster sensing section has sensed occurrence of disaster to the disaster determination processing device in addition to the disaster sensing information.

The time at which the disaster sensing section has sensed occurrence of disaster is properly transmitted to the disaster determination processing device.

In the disaster determination system according to a third aspect, the transmission unit of at least one of the sensing terminal devices sends the disaster sensing information at a predetermined interval after the disaster sensing section has sensed occurrence of disaster. Even when the disaster sensing information is not received for a period of equal to or longer than the interval from at least one of the sensing terminal devices having sent the disaster sensing information, the disaster determination section regards the at least one of the sensing terminal devices as sending the disaster sensing information.

Even when operation of the sensing terminal device having sensed occurrence of disaster and sent the disaster sensing information once is stopped due to, e.g., damage caused by disaster, the disaster determination section uses the disaster sensing information sent from such a sensing terminal device to determine the disaster occurrence position and the disaster expansion direction.

In the disaster determination system according to a fourth aspect, the transmission unit of at least one of the sensing terminal devices sends the disaster sensing information containing the physical change amount exceeding the predetermined set value when the disaster sensing section has sensed occurrence of disaster, and the disaster determination section determines the disaster occurrence position and the disaster expansion direction based on the placement position, the disaster sensing time, and the physical change amount for at least two or more of the sensing terminal devices having sent the disaster sensing information.

The disaster determination section obtains, together with the disaster sensing time, the physical change amount due to occurrence of disaster at the placement position of each sensing terminal device.

In the disaster determination system according to a fifth aspect, the disaster determination processing device transmits, via the mesh network, the disaster status to at least one of the sensing terminal devices having sent the disaster sensing information, the disaster status containing the disaster occurrence position and the disaster expansion direction determined by the disaster determination section.

Even when the path for communication with some peripheral sensing terminal devices is blocked due to occurrence of disaster, the disaster status is reliably transmitted from the disaster determination processing device to each sensing terminal device.

In the disaster determination system according to a sixth aspect, the disaster determination processing device assigns a warning rank based on a route record contained in the received disaster sensing information, the warning rank indicating a higher level of dangerousness in the order of transferring of the disaster sensing information to at least one of the sensing terminal devices; and transmits warning information corresponding to the assigned warning rank and the disaster status.

The order of transferring of the disaster sensing information to the sensing terminal device as indicated by the route record is substantially the ascending order of a distance between the disaster occurrence position and the placement position of the sensing terminal device. Thus, the warning rank with a higher level of dangerousness is assigned to the sensing terminal device closer to the disaster occurrence position, and the warning rank with a lower level of dangerousness is assigned to the sensing terminal device farther from the disaster occurrence position. The warning information corresponding to the warning rank is transmitted from the disaster determination processing device.

In the disaster determination system according to a seventh aspect, the plurality of sensing terminal devices is dispersedly placed in a building.

The disaster occurrence position and the disaster expansion direction at each position in the building can be determined.

A disaster determination method according to an eighth is a disaster determination method in which a plurality of sensing terminal devices and a disaster determination processing device dispersedly placed at different positions are connected together via a mesh network and the disaster determination processing device determines and analyzes a disaster status based on disaster sensing information sent via the mesh network from at least one of the sensing terminal devices having sensed a physical change at a placement position due to occurrence of disaster. This method includes (1) monitoring, by each sensing terminal device, a physical change amount at the placement position of the sensing terminal device and sending the disaster sensing information to the disaster determination processing device via the mesh network when occurrence of disaster has been sensed from the physical change amount exceeding a predetermined set value, terminal identification information for specifying the sensing terminal device itself and a disaster sensing time at which occurrence of disaster has been sensed being added to the disaster sensing information; (2) for at least one of the sensing terminal devices having sent the disaster sensing information, obtaining, by the disaster determination processing device, the sensing terminal device placement position specified from the terminal identification information and the disaster sensing time at which at least one of the sensing terminal devices has sensed occurrence of disaster every reception of the disaster sensing information via the mesh network; (3) determining, as a disaster occurrence position, an area surrounded by the placement positions of at least two or more of the sensing terminal devices having sent the disaster sensing information; and (4) determining, as a disaster expansion direction, a direction in which the placement position of at least one of the sensing terminal devices having sent the disaster sensing information moves in the order of two or more disaster sensing times of the disaster sensing information.

From the placement position and the disaster sensing time for at least two or more of the sensing terminal devices having sent the disaster sensing information, the disaster determination section obtains the disaster sensing times at multiple different placement positions. Thus, the disaster determination section determines, as the disaster occurrence position, the area surrounded by the multiple different placement positions at which occurrence of disaster has been sensed, and determines, as the disaster expansion direction, the direction in which the placement position of the sensing terminal device having sent the disaster sensing information moves in the order of the disaster sensing time.

According to the first and/or eighth aspects of the invention, the plurality of sensing terminal devices and the disaster determination processing device dispersedly placed at the different positions are connected together via the mesh network. Thus, even when a particular communication path is blocked due to occurrence of disaster, the disaster sensing information can be received from all of the sensing terminal devices having sensed occurrence of disaster, and the disaster occurrence position and the disaster expansion direction can be accurately determined.

Moreover, the latest disaster occurrence position and the latest disaster expansion direction can be promptly determined every time the disaster sensing information is newly received from the sensing terminal device having sensed occurrence of disaster.

According to the second aspect of the invention, the time at which the disaster sensing section of the sensing terminal device has sensed occurrence of disaster can be properly transmitted to the disaster determination processing device without influence of an internal processing time of the sensing terminal device and a delay time in the mesh network.

According to the third aspect of the invention, even when operation of the sensing terminal device having sensed occurrence of disaster and sent the disaster sensing information is stopped due to, e.g., damage caused by disaster, the disaster occurrence position and the disaster expansion direction can be accurately determined on the assumption that occurrence of disaster has been sensed at the placement position of such a sensing terminal device.

According to the fourth aspect of the invention, the disaster determination section can grasp the detailed magnitude and influence of disaster at the placement position of the sensing terminal device from the physical change amount due to occurrence of disaster at such a placement position and the disaster sensing time. Consequently, the disaster occurrence position and the disaster expansion direction can be more accurately determined.

According to the fifth aspect of the invention, the plurality of sensing terminal devices and the disaster determination processing device dispersedly placed at the different positions are connected together via the mesh network. Thus, the disaster status is reliably transmitted from the disaster determination processing device to each sensing terminal device.

The disaster status including the disaster occurrence position and the disaster expansion direction is transmitted to at least one of the sensing terminal devices having sent the disaster sensing information, and therefore, an evacuation direction and urgency in evacuation at the placement position of the sensing terminal device can be grasped.

According to the sixth aspect of the invention, the warning rank with a higher level of dangerousness is assigned to the sensing terminal device estimated as being closer to the disaster occurrence position, and the warning information corresponding to the warning rank is transmitted to such a sensing terminal device. Thus, urgency in evacuation and dangerousness of disaster can be, together with the disaster occurrence position and the disaster expansion direction, transmitted to a person near the placement position of the sensing terminal device.

According to the seventh aspect of the invention, the disaster occurrence position and the disaster expansion direction at each position in the building can be determined, and therefore, an evacuation direction in the building can be grasped from the placement position of each sensing terminal device.

DESCRIPTION OF EMBODIMENTS

Figure 1:
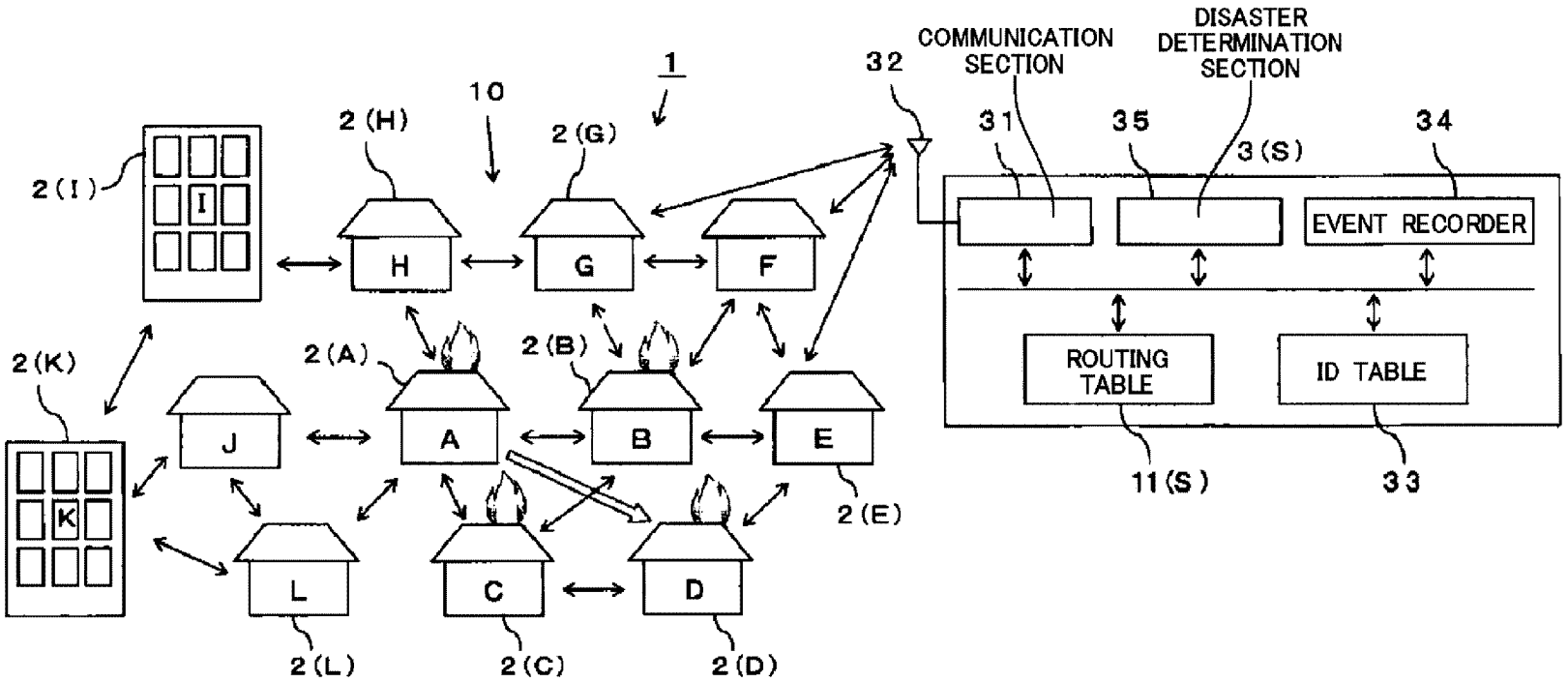
FIG. 1 is a block diagram of a disaster determination system 1 according to an embodiment of the present invention.

A disaster determination system 1 and a disaster determination method according to an embodiment of the present invention will be described below with reference to FIGS. 1 to 4. As illustrated in FIG. 1, many sensing terminal devices 2(A) to 2(L) and a disaster determination processing device 3(S) dispersedly placed at separate positions within a predetermined area serve as nodes of a mesh network 10 in the disaster determination system 1, and bidirectional communication of later-described data such as disaster sensing information, a disaster status, and warning information is allowed between a pair of any ones of the nodes via the mesh network 10. That is, in the mesh network 10, each node (the sensing terminal devices 2 and the disaster determination processing device 3) performs multi-hop communication for transferring data according to a routing table 11 stored in each node 2, 3, and the data is transmitted from an optional node 2, 3 as a source (Src) to a node 2, 3 as a final destination (Dst).

Communication between individual ones of the nodes 2, 3 may be, regardless of wired or wireless communication, a combination of wired communication and wireless communication across the entirety of the mesh network 10. However, in the present embodiment, description will be made supposing that data is transmitted/received between adjacent ones of all nodes via wireless communication. According to wireless communication, each sensing terminal device 2 can be placed at an optional placement position without the need for a fixed network, and is configured to perform multi-hop communication by independent routing.

The routing table 11 contained in each of the sensing terminal devices 2(A) to 2(L) and the disaster determination processing device 3(S) as the nodes of the mesh network 10 is dynamically updated using an ad hoc routing protocol. Before transmitting data such as the disaster sensing information, the disaster status, and the warning information to the node 2, 3 as the final destination (Dst), the node 2, 3 as the source (Src) performs multicast transmission of a route record command frame (PREQ) containing a multicast user datagram protocol (UDP) packet to the adjacent nodes 2, 3. Each relay node 2, 3 having received the PREQ add a network address thereof to a route record, and then, transfers the PREQ to the further adjacent nodes 2, 3. After repetition of similar transfer, when the node 2, 3 as the final destination (Dst) receives the PREQ, such a node 2, 3 generates a route reply command frame (PREP) containing the route record of the received PREQ, and sends back the PREP to the node 2, 3 as the source (Src) having initially transmitted the PREQ in a communication path opposite to that for the route record of the received PREQ.

Each relay node 2, 3 having received the PREP transfers the PREP to the node 2, 3 having transmitted the PREQ, and such transfer is repeated until the PREP is transferred to the node 2, 3 as the source (Src). At this point, each relay node 2, 3 for transferring the PREP stores, in the routing table 11 thereof, the communication path including the final destination (Dst) specified by the route record contained in the PREP and the node(s) 2, 3 having transmitted the PREP.

Since the node 2, 3 as the source (Src) performs multicast transmission of the PREQ to the adjacent nodes 2, 3, the node 2, 3 as the source (Src) receives the PREP through many different communication paths from the node 2, 3 as the final destination (Dst). Considering the number of hops and throughput, the node 2, 3 as the source (Src) selects an optimal communication path for transmitting data to the final destination (Dst), and stores such a communication path in the routing table 11. Thus, even when any of the sensing terminal devices 2(A) to 2(L) loses a router function due to occurrence of disaster or other reasons, another communication path through other sensing terminal devices 2 is continuously formed, and therefore, data such as the disaster sensing information, the disaster status, and the warning information can be reliably transmitted/received between the source (Src) and the final destination (Dst).

Figure 2:
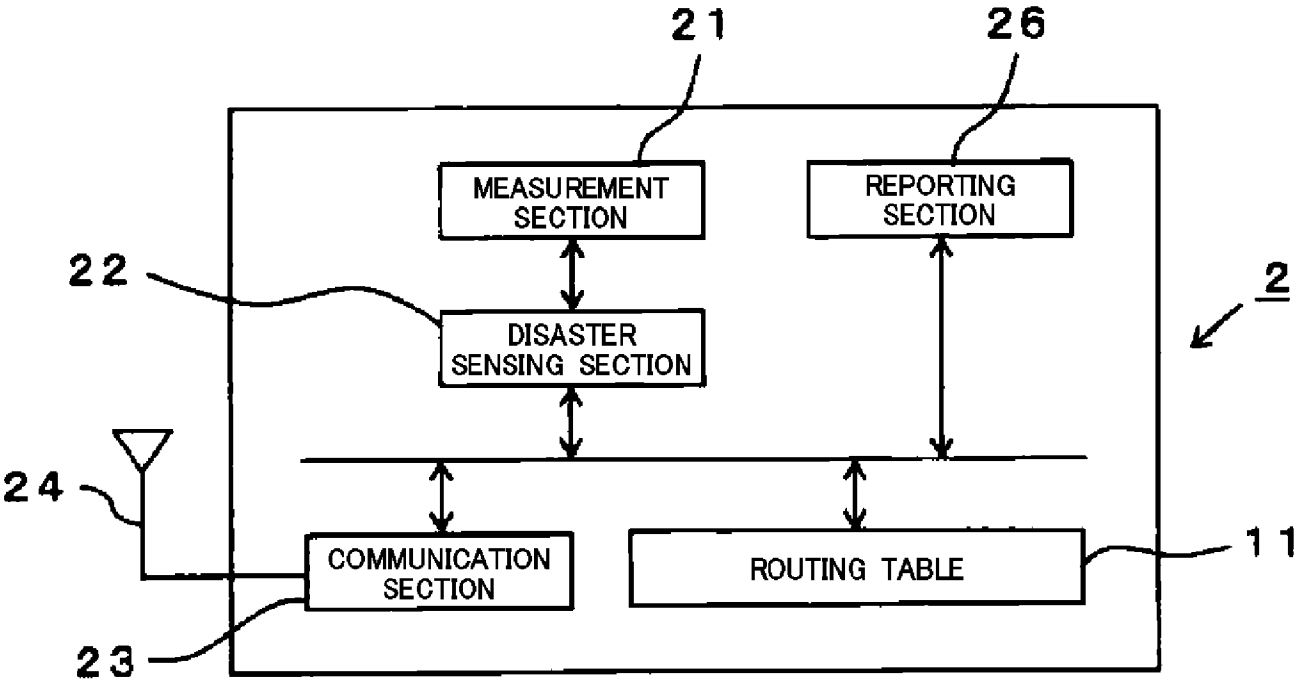
FIG. 2 is a block diagram of a sensing terminal device 2.

As illustrated in FIG. 2, each sensing terminal device 2 includes a meter 21 such as a smoke sensor, a thermometer, and a gas detector each configured to detect a physical change in smoke, a temperature, or a particular type of gas in the sensing terminal device 2, a disaster sensing section 22 including a smoke sensor, a temperature sensor, a gas leakage sensor, or a combination thereof for sensing occurrence of disaster such as fire or gas leakage when a measurement value of the meter 21 exceeds a normal change amount, a communication section 23 configured to transmit/receive, e.g., a packet of the disaster sensing information via wireless communication, a wireless antenna 24 connected to the communication section 23, the routing table 11 (11(A) to 11(L)) for specifying the sensing terminal device 2 or the disaster determination processing device 3 as the destination for multi-hop communication by the communication section 23, and a reporting section 26 such as a speaker or a display configured to report the contents of the disaster status or the warning information to the periphery when the communication section 23 receives the disaster status or the warning information.

In the present embodiment, the disaster sensing section 22 includes a combination of the smoke sensor and the temperature sensor, and is configured to sense smoke and to sense occurrence of fire at the placement position when the temperature exceeds an upper temperature limit (e.g., 70° C.) in a normal state. When the disaster sensing section 22 senses occurrence of fire, the communication section 23 generates the disaster sensing information in a format illustrated in FIG. 3, and sends the disaster sensing information via the wireless antenna 24. A header of such a packet contains network addresses specifying the sensing terminal device 2 as the disaster sensing information source (Src) having sensed occurrence of disaster and the disaster determination processing device 3 as the final destination (Dst), and the number of hops (a default is zero). A data area of the packet contains a time stamp indicating a time at which the disaster sensing section 22 has sensed occurrence of disaster, and the measurement value of the meter 21.

Supposing that the optimal communication path including the sensing terminal device 2(A) as the source (Src) having sensed occurrence of fire and the disaster determination processing device 3(S) as the final destination (Dst) according to the above-described ad hoc routing protocol is a communication path through the sensing terminal device 2(B) and the sensing terminal device 2(E) illustrated in FIG. 1 and that the optimal communication path is stored in the routing table 11(A) of the sensing terminal device 2(A), the sensing terminal device 2 as the source (Src) transmits, with reference to the routing table 11(A), the disaster sensing information to the sensing terminal device 2(B) as a destination (Next) when the final destination (Dst) is the disaster determination processing device 3(S).

Figure 4:
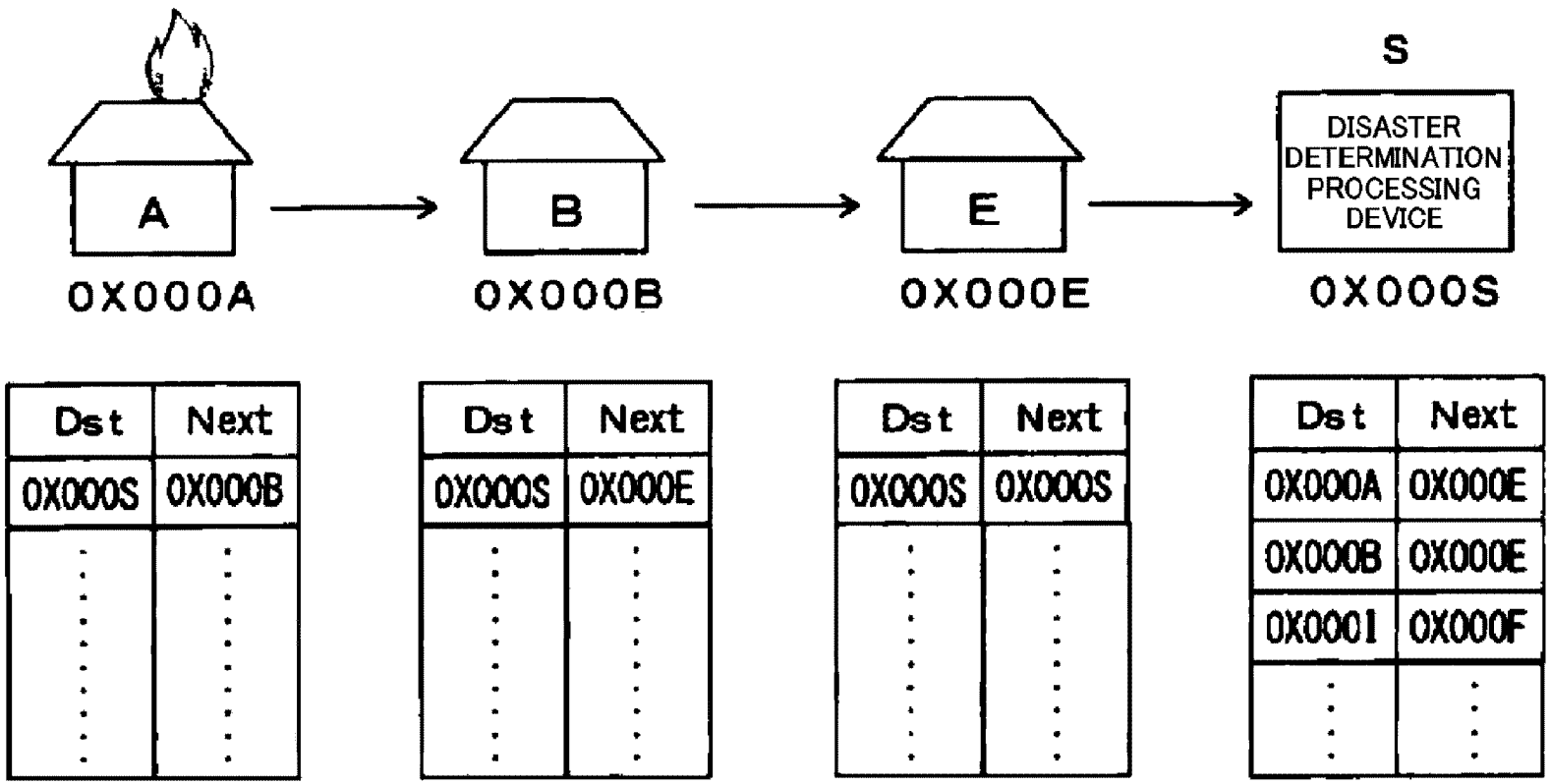
FIG. 4 is a view for describing the path for communication of the disaster sensing information.

Supposing that network addresses 0x000A, 0x000B, 0x000E, 0x000S as terminal identification information on the network are assigned respectively to the sensing terminal device 2(A), the sensing terminal device 2(B), the sensing terminal device 2(E), and the disaster determination processing device 3(S) as illustrated in FIG. 4, the network address 0x000A of the sensing terminal device 2(A) having sensed occurrence of disaster is assigned as the source (Src) of the header of the disaster sensing information, and the network address 0x000S specifying the disaster determination processing device 3(S) configured to determine the disaster status from the disaster sensing information is assigned as the final destination (Dst).

The sensing terminal device 2(B) as the relay node having received the disaster sensing information from the sensing terminal device 2(A) obtains, from the routing table 11(B) of the sensing terminal device 2(B), the sensing terminal device 2(E) as a next destination when the final destination (Dst) is the network address 0x000S of the disaster determination processing device 3(S), and then, transfers the disaster sensing information to the sensing terminal device 2(E). In such transfer, the sensing terminal device 2(B) adds the network address 0x000B specifying the sensing terminal device 2(B) itself to the route record of the disaster sensing information, and increments the number of hops. Then, the sensing terminal device 2(B) transfers the disaster sensing information to the sensing terminal device 2(E).

Figure 3:
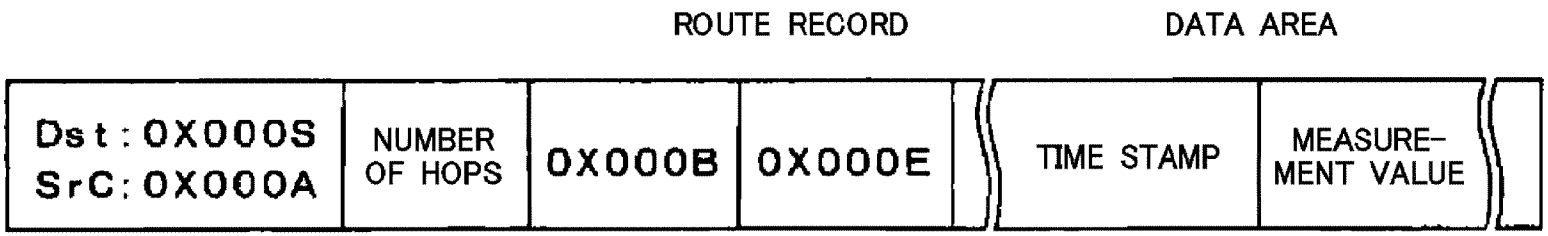
FIG. 3 is a view for describing a packet of disaster sensing information.

As in the sensing terminal device 2(B), the sensing terminal device 2(E) as the relay node performs the processing of transferring the disaster sensing information, and transmits, with reference to the routing table 11(E) of the sensing terminal device 2(E), the disaster sensing information to the disaster determination processing device 3(S) as the final destination (Dst). As a result, 0x000B and 0x000E indicating the communication path are added to the route record of the disaster sensing information received by the disaster determination processing device 3(S) as illustrated in FIG. 3. Moreover, the number of hops indicates the number of transfer of the disaster sensing information in the mesh network 10, and therefore, is "2" indicating the number of transfer at the sensing terminal device 2(B) and the sensing terminal device 2(E).

The communication section 23 of the sensing terminal device 2 having sensed occurrence of disaster by the disaster sensing section 22 similarly transmits the disaster sensing information to the disaster determination processing device 3(S) at a constant interval of 10 seconds until reset, for example. The measurement value of the meter 21 and the time stamp contained in the data area of the disaster sensing information repeatedly transmitted at intervals are the value and time of measurement by the meter 21 when the disaster sensing information is re-transmitted. Thus, the disaster determination processing device 3(S) receiving the disaster sensing information from the same sensing terminal device 2 at the constant interval can observe a physical change amount at the placement position of the sensing terminal device 2 over time.

As illustrated in FIG. 1, the disaster determination processing device 3 includes a communication section 31 configured to transmit/receive, e.g., a packet of the disaster sensing information, the disaster status, or the warning information via wireless communication; a wireless antenna 32 connected to the communication section 31; the routing table 11(S) for specifying the sensing terminal device 2 as the destination for multi-hop communication by the communication section 31; an ID table 33 configured to store an association between the network address of each sensing terminal device 2 connected via the mesh network 10 and the placement position of such a sensing terminal device 2; an event recorder 34 configured to store event information every reception of the disaster sensing information, the event information indicating an association among the network address of the sensing terminal device 2 having sent the disaster sensing information, i.e., the network address described as the source (Src) of the received disaster sensing information, and the time stamp and the measurement value of the meter 21 contained in the disaster sensing information; and a disaster determination section 35 configured to determine the disaster status including a disaster occurrence position and a disaster expansion direction from the ID table 33 and the event information stored in the event recorder 34.

The disaster determination section 35 extracts, every time the disaster sensing information is newly received, one or more network addresses of all pieces of the event information from the event recorder 34. The extracted network address is the network address of the sensing terminal device 2 having sent the disaster sensing information, and therefore, it can be estimated that disaster occurs at the placement position of the sensing terminal device 2 specified by such a network address. Thus, for each extracted network address, the disaster determination processing device 3 detects, with reference to the ID table 33, the placement position of the sensing terminal device 2 associated with the network address, and then, determines the vicinity of the detected placement position or an area surrounded by the detected placement positions as the disaster occurrence position.

Moreover, every time the disaster sensing information is newly received, the disaster determination section 35 extracts, from all pieces of the event information stored in the event recorder 34, the event information with the oldest time stamp for one or more network addresses described above. The event information with the oldest time stamp for the network addresses indicates the time at which the disaster sensing section 22 of the sensing terminal device 2 specified by the network address has first sensed occurrence of disaster and the measurement value of the meter 21 of such a sensing terminal device 2. Thus, when the placement position of the sensing terminal device 2 associated with the network address is detected with reference to the ID table 33, the time at which occurrence of disaster has been first sensed at the placement position of the sensing terminal device 2 is obtained. Consequently, the disaster determination processing device 3 can obtain, from the event information extracted for each network address and the placement position of the sensing terminal device 2 associated with each network address, the time at which occurrence of disaster has been first sensed at multiple different positions, and as a result, can determine the disaster expansion direction.

Supposing that fire caused at the placement position of the sensing terminal device 2(A) of FIG. 1 expands in a lower right direction as viewed in the figure and that the sensing terminal device 2(A), the sensing terminal device 2(C), the sensing terminal device 2(B), and the sensing terminal device 2(D) first sense occurrence of disaster in this order at the placement positions thereof, the time stamp of the event information extracted for each network address (each sensing terminal device 2) by the disaster determination processing device 3 indicates the time elapsed in the order of the network addresses of the sensing terminal device 2(A), the sensing terminal device 2(C), the sensing terminal device 2(B), and the sensing terminal device 2(D). Thus, when the placement position of the sensing terminal device 2 associated with each network address is obtained with reference to the ID table 33, it can be estimated that occurrence of disaster has been sensed in the order of the placement positions of the sensing terminal device 2(A), the sensing terminal device 2(C), the sensing terminal device 2(B), and the sensing terminal device 2(D). Consequently, the lower right direction indicated by a white arrow in FIG. 1 is determined as a fire expansion direction.

As described above, the sensing terminal device 2 having sensed occurrence of disaster once repeats transmission of the disaster sensing information at the constant interval (in this case, an interval of 10 seconds) even after transmission of the disaster sensing information, and the event information is stored with the association among the network address, the time stamp, and the measurement value of the meter 21 in the event recorder 34. Thus, the measurement value of the meter 21 is obtained at the time indicated by the time stamp at the placement position of the sensing terminal device 2 specified by the network address. The disaster determination section 35 sorts the event information for each network address according to the time stamp, and compares transition of the measurement value. In this manner, the disaster determination section 35 can more specifically grasp, from the physical change amount of heat, a gas concentration, etc., a chronological change in influence due to disaster at the placement position of the sensing terminal device 2 specified by the network address.

Moreover, transition of the measurement value is compared among the placement positions of the sensing terminal devices 2 specified by two or more network addresses so that the disaster status including the disaster occurrence position and the disaster expansion direction can be more accurately determined.

Even when the disaster sensing information transmitted at the constant interval from the sensing terminal device 2 having sent the disaster sensing information once is lost, the disaster occurrence position and the disaster expansion direction are determined using, as effective information, the event information having already stored for the sensing terminal device 2 in the event recorder 34. This is because of the following reason. There is a case where the disaster sensing information can be no longer transmitted due to disaster influence such as disappearing of the sensing terminal device 2 itself having sent the disaster sensing information. In this case, it is estimated that disaster continuously occurs at the placement position of such a sensing terminal device 2.

When the disaster determination section 35 determines the disaster status including the disaster occurrence position and the disaster expansion direction, the disaster determination processing device 3 transmits the determined disaster status from the communication section 31 to the sensing terminal device 2 to notify danger due to disaster at the placement position of the sensing terminal device 2 and provide evacuation guidance. The disaster status may be transmitted to all of the sensing terminal devices 2 connected to the disaster determination processing device 3 via the mesh network 10. However, there is a probability that the network is congested upon occurrence of disaster. For this reason, an area where disaster has already occurred or an area in danger of disaster may be specified from the disaster occurrence position and the disaster expansion direction determined by the disaster determination section 35, and the disaster status may be transmitted only to the sensing terminal device(s) 2 placed in such an area.

Supposing that the disaster determination processing device 3 receives the disaster sensing information from the sensing terminal device 2(A) and the sensing terminal device 2(C) and that the disaster determination section 35 determines an area connecting between the placement positions of the sensing terminal device 2(A) and the sensing terminal device 2(C) as the disaster occurrence position and determines the lower right direction in FIG. 1 as the disaster expansion direction, the disaster status is transmitted to the sensing terminal device 2(B), the sensing terminal device 2(D), the sensing terminal device 2(G), the sensing terminal device 2(H), the sensing terminal device 2(J), and the sensing terminal device 2(L) adjacent to the placement positions of the sensing terminal device 2(A) and the sensing terminal device 2(C) and to the sensing terminal device 2(E) estimated as being in the disaster expansion direction.

In the disaster determination processing device 3, a distance between the placement position of the sensing terminal device 2 having sensed occurrence of disaster and the placement position of each relay sensing terminal device 2 interposed in the path for communication of the disaster sensing information can be estimated from the route record of the received disaster sensing information. That is, a lower number of hops of the relay sensing terminal device 2 having received the disaster sensing information from the source (Src) results in a closer placement position of the relay sensing terminal device 2 to the placement position of the sensing terminal device 2 having sensed occurrence of disaster. Thus, from the route record contained in the disaster sensing information, the disaster determination processing device 3 provides a warning rank in the disaster determination section 35, the warning rank indicating a higher level of dangerousness in the order of transferring of the disaster sensing information to the sensing terminal device 2. The disaster determination processing device 3 transmits the warning information corresponding to the warning rank and the disaster status to the sensing terminal devices 2 so that, e.g., urgency in evacuation can be notified. Note that the warning rank provided in the disaster determination section 35 may be determined and provided to each sensing terminal device 2 from a combination of the route record and the disaster status including the disaster occurrence position and the disaster expansion direction or only from the disaster status.

When the disaster determination processing device 3 transmits the disaster status or the disaster status and the warning information (hereinafter referred to as the "disaster status etc.") to a specific sensing terminal device 2, such a sensing terminal device 2 is taken as the final destination (Dst), and the disaster status etc. are, with reference to the routing table 11(S) of the disaster determination processing device 3, transmitted to a sensing terminal device 2 as the destination (Next) stored in association with the final destination (Dst). As a result, the disaster status etc. are transmitted to the specific sensing terminal device 2 as the final destination (Dst) in the optimal communication path of the mesh network 10.

The sensing terminal device 2 having received the disaster status etc. from the disaster determination processing device 3 uses the reporting section 26 such as the speaker or the display to report the disaster status to the periphery of the sensing terminal device 2, thereby notifying danger and the need for evacuation. Since the disaster status includes the disaster occurrence position and the disaster expansion direction, a person having been reported from the reporting section 26 can determine an evacuation direction and the need for evacuation. Further, when the disaster status includes the warning information corresponding to the warning rank determined by the disaster determination section 35, the warning information is reported so that, e.g., approaching disaster and the urgency in evacuation can be promptly determined in more detail.

As illustrated in FIG. 1, the above-described disaster determination system 1 is configured such that many sensing terminal devices 2(A) to 2(L) and the disaster determination processing device 3(S) as the nodes of the mesh network 10 are dispersedly placed at the separate positions within the predetermined area. However, many sensing terminal devices 2(Kmn) and a disaster determination processing device 3(Ks) as nodes may be dispersedly placed at different positions in a building, and the nodes 2, 3 may be connected together via a mesh network 50.

Figure 5:
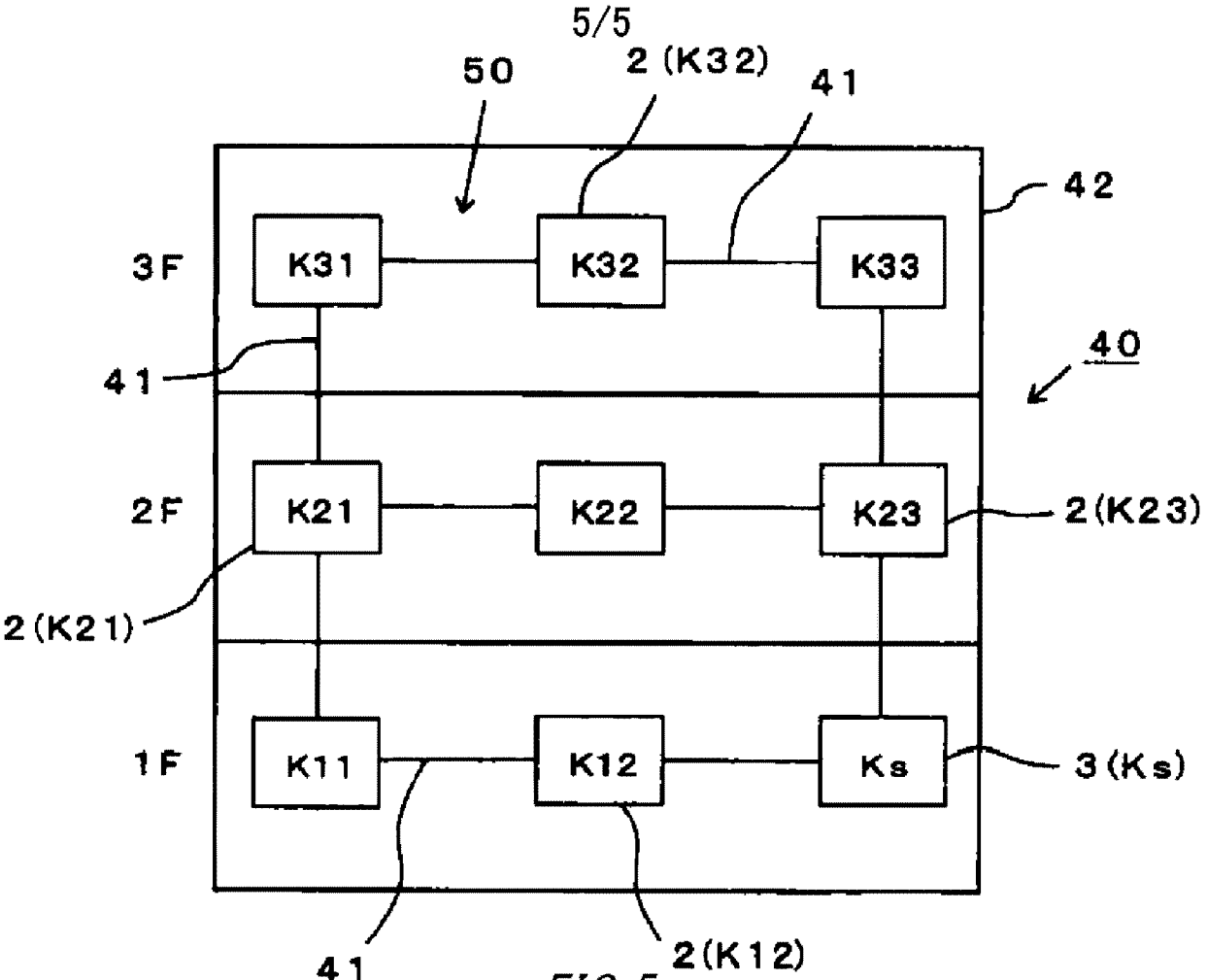
FIG. 5 is a block diagram of a disaster determination system 40 according to a second embodiment in which many sensing terminal devices Kmn are arranged in a building.

A disaster determination system 40 of a second embodiment will be described below with reference to FIG. 5, the disaster determination system 40 being configured such that many sensing terminal devices 2(Kmn) and a disaster determination processing device 3(Ks) connected together via a mesh network 50 are dispersedly placed at each position in a building 42. The disaster determination system 40 of the second embodiment is different from the above-described disaster determination system 1 in the placement positions of many sensing terminal devices 2(Kmn) and the disaster determination processing device 3(Ks). Such differences are as follows: adjacent ones of the devices (the nodes) 2, 3 are connected together via a wired cable 41; and the disaster determination processing device 3(Ks) also serves as the sensing terminal device 2(Kmn). Other configurations are the same between the first and second embodiments. Thus, the same reference numerals are used to represent common elements, and detailed description thereof will not be repeated.

The disaster determination processing device 3(Ks) includes a not-shown connection interface section configured to connect the disaster determination processing device 3(Ks) to the adjacent sensing terminal devices 2(K12) and the sensing terminal device 2(K23) via the wired cables 41, instead of the wireless antenna 32 illustrated in FIG. 1. The disaster determination processing device 3(Ks) further includes a communication section 31 as provided at the disaster determination processing device 3 of FIG. 1, a routing table 11(Ks) for specifying the sensing terminal device 2(Kmn) as a destination for multi-hop communication in the mesh network 50, an ID table 33 configured to store an association between a network address of each sensing terminal device 2(Kmn) of the mesh network 50 and the placement position of such a sensing terminal device 2(Kmn), an event recorder 34, and a disaster determination section 35. In addition, the disaster determination processing device 3(Ks) still further includes a meter 21 functioning as in the sensing terminal device 2 of FIG. 2, a disaster sensing section 22, and a reporting section 26. The disaster determination processing device 3(Ks) has functions of the sensing terminal device 2 and the disaster determination processing device 3. The disaster determination processing device 3(Ks) is placed at a corner of a first floor of the building 42. The disaster determination processing device 3(Ks) is, via the wired cables 41, connected to the adjacent sensing terminal device 2(K12) placed at the center of the first floor and to the sensing terminal device 2(K23) placed at a corner of a second floor.

In addition to a not-shown connection interface section for connection with the adjacent sensing terminal device 2(Kmn) or the disaster determination processing device 3(Ks) via the wired cable 41 instead of the wireless antenna 24, the sensing terminal device 2(Kmn) includes the configuration of the sensing terminal device 2 illustrated in FIG. 2. As illustrated in FIG. 5, the plurality of sensing terminal devices Kmn are dispersedly placed at each of the first to third floors of the building 42, and are each connected to the adjacent sensing terminal device 2(Kmn) or the disaster determination processing device 3(Ks) via the wired cable 41 such that the mesh network 50 is formed in the building 42.

The disaster sensing section 22 provided at each sensing terminal device 2(Kmn) or the disaster determination processing device 3(Ks) is, as in the first embodiment, a combination of a smoke sensor and a temperature sensor for sensing of occurrence of fire. When any of the sensing terminal devices 2(Kmn) senses occurrence of fire at the placement position thereof, disaster sensing information is transmitted to the disaster determination processing device 3(Ks) by multi-hop communication via the mesh network 50.

The disaster determination processing device 3(Ks) having received the disaster sensing information from any of the sensing terminal devices 2(Kmn) stores event information in the event recorder 34 every reception of the disaster sensing information, the event information indicating an association among the network address described as a source (Src) of the disaster sensing information and a time stamp and a measurement value of the meter 21 contained in the disaster sensing information. When the disaster sensing section 22 of the disaster determination processing device 3(Ks) itself has sensed occurrence of fire, the event information indicating the association among the network address of the disaster determination processing device 3(Ks) itself, the time stamp indicating a measurement time, and the measurement value of the meter 21 is stored in the event recorder 34.

The disaster determination section 35 determines, based on all pieces of the stored event information, a fire occurrence position and a fire expansion direction in the building 42 every time the event information is newly stored in the event recorder 34. Then, the disaster determination section 35 outputs the determined disaster status to the reporting section 26 of the disaster determination section 35 itself, and transmits the disaster status to all of the sensing terminal devices 2(Kmn). With this configuration, the fire occurrence position and the fire expansion direction can be obtained from the reporting section 26 placed at each position in the building 42, and an evacuation direction and an evacuation path can be promptly determined.

Note that the disaster determination system 40 of the second embodiment can be formed as a portion of a disaster determination system provided with a wider mesh network. For example, when the above-described disaster determination processing device 3(Ks) is assigned with the network address of the mesh network 10 and is configured as the sensing terminal device 2(K) of FIG. 1 by the wireless antenna 24 provided for wireless communication with the adjacent sensing terminal devices 2, the disaster determination processing device 3(Ks) also functions as the node of the mesh network 10, and the disaster determination system 40 can be formed as a portion of the disaster determination system 1 with the wider mesh network 10.

According to each embodiment described above, each sensing terminal device 2 includes the routing table 11, and has the function of the router of the mesh network 10, 50. However, some sensing terminal devices 2 such as a sensing terminal device star-connected to the sensing terminal device 2 including the routing table 11 do not necessarily function as routers as long as the source (Src) of the disaster sensing information to be sent on the mesh network and the placement position of the source (Src) can be specified, for example.

Moreover, the placement position of the sensing terminal device 2 is referred from the ID table 33 of the disaster determination processing device 3 configured to store the association between the network address and the placement position of the sensing terminal device 2. However, the disaster sensing information may be transmitted to the disaster determination processing device 3 with the disaster sensing information containing information on the placement position of the sensing terminal device 2 having sensed occurrence of disaster.

Further, the disaster sensing time at which occurrence of disaster has been sensed by the disaster sensing section 22 is contained in the disaster sensing information, and is indicated by the time stamp transmitted to the disaster determination processing device 3. However, when an internal processing time of the sensing terminal device 2 and a communication time via the mesh network 10, 50 are negligibly short in determination of the disaster expansion direction, the disaster sensing time may be estimated from a time at which the sensing terminal device 2 having sensed occurrence of disaster has sent the disaster sensing information or a time at which the disaster sensing information has been received by the communication section 31 of the disaster determination processing device 3.

INDUSTRIAL APPLICABILITY

The embodiments of the present invention is suitable for a disaster determination system and a disaster determination method for guiding proper direction and path for evacuation from disaster expanding in an uncertain direction, such as fire.

REFERENCE SIGNS LIST

1 disaster determination system (first embodiment)
2 sensing terminal device
3 disaster determination processing device
10 mesh network
22 disaster sensing section
23 communication section (transmission unit)
24 wireless antenna (transmission unit)
35 disaster determination section
40 disaster determination system (second embodiment)
42 building

The invention claimed is:

1. A disaster determination system configured such that a plurality of sensing terminal devices and a disaster determination processing device dispersedly placed at different positions are connected together via a mesh network utilizing multi-hop communication and that the disaster determination processing device determines a disaster status based on disaster sensing information sent via the mesh network from at least one of the plurality of sensing terminal devices having sensed a physical change at a placement position due to occurrence of disaster, wherein each sensing terminal device includes a disaster sensing section configured to monitor a physical change amount at the placement position and sense occurrence of the disaster when the physical change amount exceeds a predetermined set value, and a transmission unit configured to send the disaster sensing information to the disaster determination processing device via the mesh network when the disaster sensing section has sensed occurrence of the disaster, terminal identification information for specifying the each sensing terminal device itself being added to the disaster sensing information, the disaster determination processing device includes a disaster determination section configured to determine the disaster status based on the disaster sensing information received from the at least one of the plurality of sensing terminal devices via the mesh network, the disaster determination section obtains, for the at least one of the plurality of sensing terminal devices having sent the disaster sensing information, the sensing terminal device placement position specified from the terminal identification information and a disaster sensing time at which the at least one of the plurality of sensing terminal devices has sensed occurrence of the disaster every reception of the disaster sensing information, and determines a disaster occurrence position and a disaster expansion direction from the placement position and the disaster sensing time for at least two or more of the plurality of sensing terminal devices having sent the disaster sensing information, and the disaster determination processing device assigns a warning rank based on a number of hops included in a route record contained in the received disaster sensing information, the warning rank indicating a higher level of dangerousness in an order of transferring of the disaster sensing information to the at least one of the plurality of sensing terminal devices, and transmits, via the mesh network, to the at least one of the plurality of sensing terminal devices having sent the disaster sensing information, warning information corresponding to the assigned warning rank and the disaster status containing the disaster occurrence position and the disaster expansion direction determined by the disaster determination section.

2. The disaster determination system according to claim 1, wherein in addition to the disaster sensing information, the transmission unit sends, as the disaster sensing time, the time at which the disaster sensing section has sensed occurrence of the disaster to the disaster determination processing device.

3. The disaster determination system according to any one of claim 1, wherein the transmission unit of the at least one of the plurality of sensing terminal devices sends the disaster sensing information at a predetermined interval after the disaster sensing section has sensed occurrence of the disaster, and even when the disaster sensing information is not received for a period of equal to or longer than the interval from the at least one of the plurality of sensing terminal devices having sent the disaster sensing information, the disaster determination section regards the at least one of the plurality of sensing terminal devices as sending the disaster sensing information.

4. The disaster determination system according to claim 1, wherein the transmission unit of the at least one of the plurality of sensing terminal devices sends the disaster sensing information containing the physical change amount exceeding the predetermined set value when the disaster sensing section has sensed occurrence of the disaster, and the disaster determination section determines the disaster occurrence position and the disaster expansion direction based on the placement position, the disaster sensing time, and the physical change amount for the at least two or more of the plurality of sensing terminal devices having sent the disaster sensing information.

5. The disaster determination system according to claim 1, wherein the plurality of sensing terminal devices is dispersedly placed in a building.

6. A disaster determination method in which a plurality of sensing terminal devices and a disaster determination processing device dispersedly placed at different positions are connected together via a mesh network utilizing multi-hop communication and the disaster determination processing device determines and analyzes a disaster status based on disaster sensing information sent via the mesh network from at least one of the plurality of sensing terminal devices having sensed a physical change at a placement position due to occurrence of disaster, comprising:

(1) monitoring, by each sensing terminal device, a physical change amount at the placement position of the each sensing terminal device and sending the disaster sensing information to the disaster determination processing device via the mesh network when occurrence of the disaster has been sensed from the physical change amount exceeding a predetermined set value, terminal identification information for specifying the each sensing terminal device itself and a disaster sensing time at which occurrence of the disaster has been sensed being added to the disaster sensing information;

(2) for the at least one of the plurality of sensing terminal devices having sent the disaster sensing information, obtaining, by the disaster determination processing device, the sensing terminal device placement position specified from the terminal identification information and the disaster sensing time at which the at least one of the plurality of sensing terminal devices has sensed occurrence of the disaster every reception of the disaster sensing information via the mesh network;

(3) determining, as a disaster occurrence position, an area surrounded by the placement positions of at least two or more of the plurality of sensing terminal devices having sent the disaster sensing information;

(4) determining, as a disaster expansion direction, a direction in which the placement position of the at least one of the plurality of sensing terminal devices having sent the disaster sensing information moves in an order of two or more disaster sensing times of the disaster sensing information;

(5) assigning a warning rank based on a number of hops included in a route record contained in the received disaster sensing information, the warning rank indicating a higher level of dangerousness in an order of transferring of the disaster sensing information to the at least one of the plurality of sensing terminal devices, and (6) transmitting, via the mesh network, to the at least one of the plurality of sensing terminal devices having sent the disaster sensing information, warning information corresponding to the assigned warning rank and the disaster status containing the disaster occurrence position and the disaster expansion direction.

7. The disaster determination system according to claim 1, wherein the transmission unit performs multicast communication to adjacent sensing terminal devices so as to send the disaster sensing information to the disaster determination processing device via the mesh network when the disaster sensing section has sensed occurrence of the disaster.

8. The disaster determination system according to claim 7, wherein each of the sensing terminal device includes a routing table that is dynamically updated using an ad hoc routing protocol.

9. The disaster determination system according to claim 8, wherein the routing table includes at least one communication path that is identified by at least one route reply command frame (PREP) received from the disaster determination processing device via the mesh network.

* * * * *